US008714355B2

(12) United States Patent
Huang

(10) Patent No.: US 8,714,355 B2
(45) Date of Patent: May 6, 2014

(54) INTEGRATED STORAGE SYSTEM WITH LOCKING CONTAINERS

(75) Inventor: Jin Chi Huang, Taichung (TW)

(73) Assignee: Stanley Black & Decker, Inc., New Britain, CT (US)

( * ) Notice: Subject to any disclaimer, the term of this patent is extended or adjusted under 35 U.S.C. 154(b) by 861 days.

(21) Appl. No.: 12/398,134

(22) Filed: Mar. 4, 2009

(65) Prior Publication Data

US 2010/0224527 A1 Sep. 9, 2010

(51) Int. Cl.
*A47B 88/20* (2006.01)

(52) U.S. Cl.
USPC ..... 206/503; 206/373; 206/372; 206/315.11; 206/370; 206/459.1; 206/509; 220/520; 220/23.86; 220/23.6; 312/332.1; 312/111; 312/107; 312/333; 190/120; 190/18 A; 190/3

(58) Field of Classification Search
USPC ..... 206/503, 370, 372, 373, 504; 312/107, 312/111, 112, 217, 218, 332, 333
See application file for complete search history.

(56) References Cited

U.S. PATENT DOCUMENTS

| | | | | |
|---|---|---|---|---|
| 921,895 | A * | 5/1909 | Sampson | 312/218 |
| 3,522,963 | A | 8/1970 | Farnden | |
| 3,878,939 | A | 4/1975 | Wilcox | |
| 3,888,525 | A | 6/1975 | Kousens | |
| 4,276,893 | A | 7/1981 | Enomoto et al. | |
| 4,619,363 | A | 10/1986 | Wolfseder | |
| 4,790,579 | A | 12/1988 | Maxwell et al. | |
| 5,149,152 | A | 9/1992 | Lanius | |
| 5,176,281 | A | 1/1993 | Fiore | |
| 5,244,265 | A | 9/1993 | Chiang | |
| 5,292,191 | A | 3/1994 | Slivon | |
| 5,325,966 | A | 7/1994 | Chang | |
| 5,388,902 | A | 2/1995 | Huebschen et al. | |
| 5,403,139 | A | 4/1995 | Slivon et al. | |
| 5,445,451 | A | 8/1995 | Harmony | |
| 5,603,559 | A | 2/1997 | Yemini | |
| 5,725,097 | A | 3/1998 | Bettenhausen et al. | |
| 5,761,030 | A | 6/1998 | Roscoe | |
| 5,775,140 | A | 7/1998 | Hallsten | |
| 5,826,719 | A | 10/1998 | Chen | |
| 5,906,381 | A * | 5/1999 | Hovatter | 280/47.18 |
| D414,673 | S | 10/1999 | Dickinson et al. | |

(Continued)

OTHER PUBLICATIONS

Office Action as issued for Taiwanese Patent Application No. 099106179, dated Sep. 10, 2012.

*Primary Examiner* — Anthony Stashick
*Assistant Examiner* — Cynthia Collado
(74) *Attorney, Agent, or Firm* — Pillsbury Winthrop Shaw Pittman LLP

(57) ABSTRACT

A container system includes a plurality of containers, a plurality of container receiving regions, a plurality of base unit latches, and a base unit. Each base unit latch is arranged to latch an associated one of the containers at least partially within an associated one of the container receiving regions. The containers may be transported separately from the base unit, and may be used to store tools and other accessories. In one embodiment of the container system, each base unit latch comprises a resilient latch member connected to the base unit. The resilient latch member is biased into a lock position to engage a lock engagement portion on an associated one of the containers. The resilient latch member may be movable against the bias to a release position wherein the associated container is able to be removed from the associated container receiving region.

30 Claims, 10 Drawing Sheets

(56) References Cited

U.S. PATENT DOCUMENTS

| | | | | |
|---|---|---|---|---|
| 6,105,769 | A | | 8/2000 | Chen |
| 6,415,924 | B1 | | 7/2002 | Lee |
| 6,422,386 | B1 | | 7/2002 | Wiese et al. |
| 6,431,615 | B1 | | 8/2002 | Bastian |
| D465,720 | S | | 11/2002 | Persson |
| D481,293 | S | | 10/2003 | Ayrest |
| 6,637,592 | B1 | | 10/2003 | Lai |
| 6,764,148 | B2 | | 7/2004 | Morris et al. |
| 6,796,625 | B2 | | 9/2004 | Lauchner et al. |
| 6,889,838 | B2 | | 5/2005 | Meier et al. |
| 6,955,380 | B1 | | 10/2005 | Barr |
| D517,805 | S | | 3/2006 | Hosking |
| D526,381 | S | * | 8/2006 | Gustlin ..... D22/143 |
| D526,782 | S | * | 8/2006 | Hosking ..... D3/296 |
| D526,895 | S | * | 8/2006 | Sisinni ..... D9/432 |
| 7,121,638 | B1 | | 10/2006 | Eggert et al. |
| 7,219,969 | B2 | | 5/2007 | Bezzubov |
| 2003/0132687 | A1 | | 7/2003 | Morris et al. |
| 2004/0188294 | A1 | | 9/2004 | Chen |
| 2006/0027475 | A1 | | 2/2006 | Gleason et al. |
| 2006/0152117 | A1 | | 7/2006 | Goetsch et al. |
| 2007/0103039 | A1 | | 5/2007 | Holcomb et al. |
| 2008/0197040 | A1 | | 8/2008 | Lin et al. |

* cited by examiner

INTEGRATED STORAGE SYSTEM WITH LOCKING CONTAINERS

FIELD OF THE INVENTION

The present invention relates to a storage system with separable carrying containers.

BACKGROUND OF THE INVENTION

Conventional tool cases commonly comprise of a body and a lid connected to the body. The case body has compartments, containers, or drawers for holding tools and accessories.

However, tool cases typically do not have lockable/releasable containers that may be carried separately. There is a need in the art for an improved storage system.

SUMMARY OF THE INVENTION

A container system is disclosed. The container system comprises a base unit, the base unit having a plurality of container receiving regions, and a base handle to facilitate transport of the base unit. The container system further comprises a plurality of containers, each of the containers being constructed to be received in an associated one of the container receiving regions, each of the containers having a container handle to facilitate transport of each container separately from the base unit, each container having a first portion and a second portion, wherein relative movement of the first and second portions between an opened and closed position permits and prevents access to contents of the container, each container having at least one container latch to enable the container to be latched in the closed position. The container system further comprises a plurality of base unit latches, each base unit latch arranged to latch an associated one of the containers at least partially within the associated one of the container receiving regions.

In another aspect of the invention, the container system comprises a base unit, the base unit having a plurality of container receiving regions. The container system further comprises a plurality of containers, each of the containers being constructed to be received in an associated one of the container receiving regions, each of the containers having a lock engagement portion. The container system further comprises a plurality of base unit latches, each base unit latch arranged to latch one of the containers at least partially within the associated one of the container receiving regions, each base unit latch comprising a resilient latch member connected to the base unit, the resilient latch member being biased into a lock position wherein it engages the lock engagement portion of the associated one of the containers to prevent the container from being removed from the container receiving region, the resilient latch member being movable against the bias thereof to a release position wherein the associated container is able to be removed from the container receiving region.

These and other aspects of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment of the invention, the structural components illustrated herein are drawn to scale. It is to be expressly understood, however, that the drawings are for the purpose of illustration and description only and are not a limitation of the invention. In addition, it should be appreciated that structural features shown or described in any one embodiment herein can be used in other embodiments as well. As used in the specification and in the claims, the singular form of "a", "an", and "the" include plural referents unless the context clearly dictates otherwise.

DETAILED DESCRIPTION OF THE INVENTION

Figure 1:
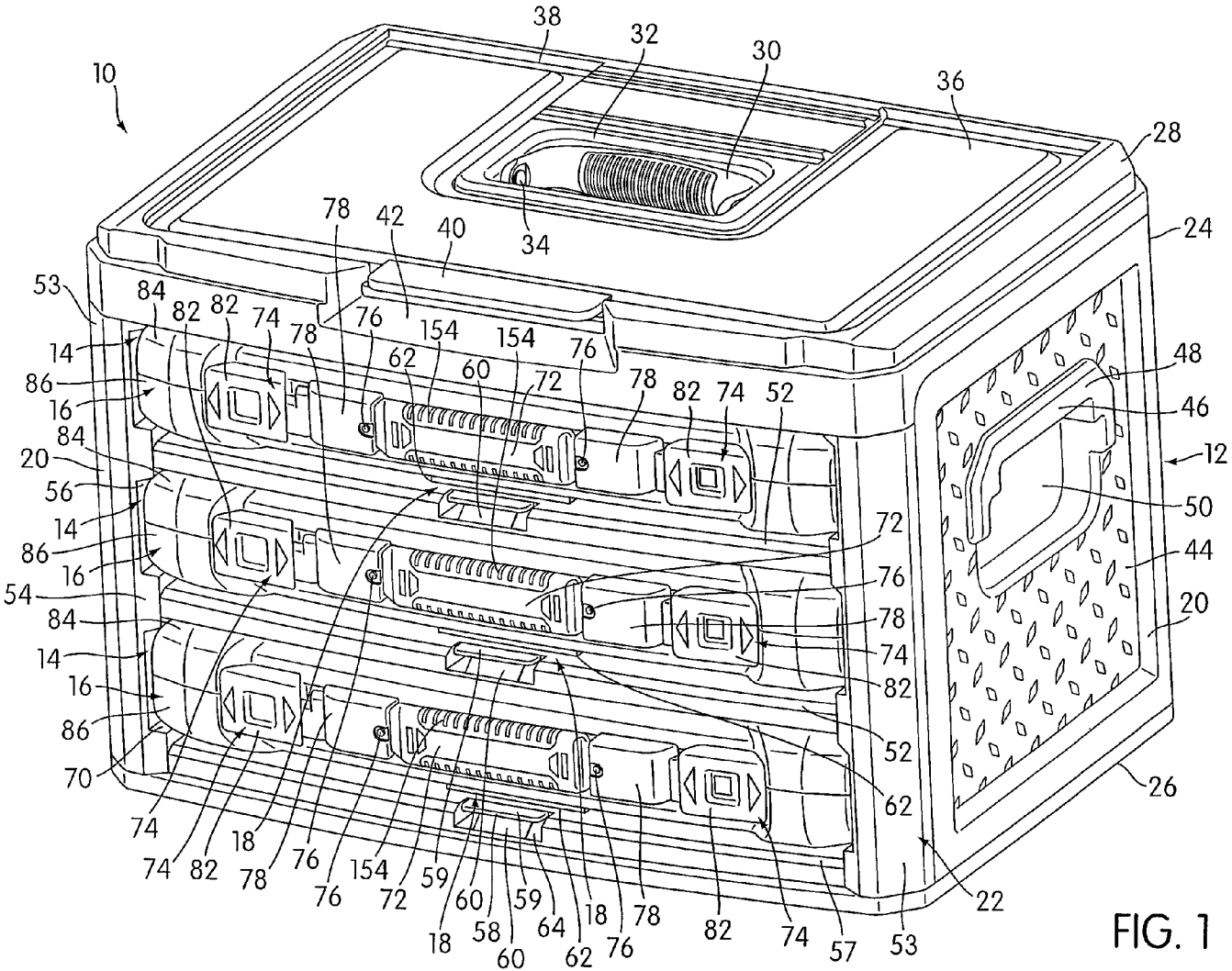
FIG. 1 is a perspective view of a container system in accordance with an embodiment of the present invention.

FIG. 1 shows a container system 10 in accordance with an embodiment of the present invention. The container system 10 includes a base unit 12, which has a plurality of container receiving regions 14. The container system 10 further includes a plurality of containers 16 and a plurality of base unit latches 18. The containers 16 are received in associated container receiving regions 14 in the base unit 12. Each base unit latch 18 is arranged to latch an associated one of the containers 16 at least partially within the associated one of the container receiving regions 14.

In the embodiment shown in FIG. 1, the base unit 12 is made of plastic. The use of plastic is not intended to be limiting, and the base unit 12 may be made of metal, wood, a combination of materials thereof, or any other suitable material as is well known in the art. The containers 16 may also be made of plastic, wood, metal, a combination of materials thereof, or any other suitable material as is well known in the art.

Figure 2:
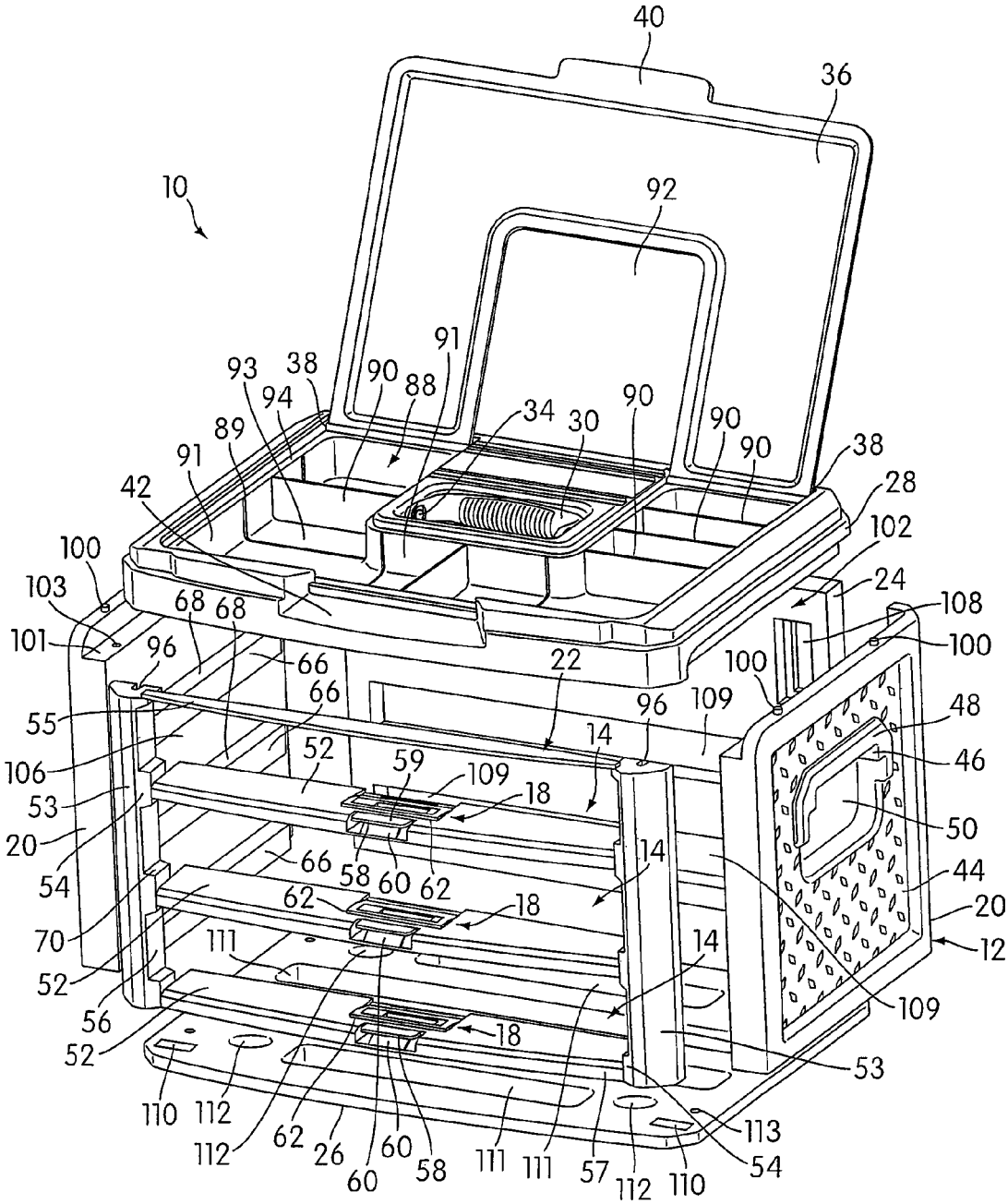
FIG. 2 is an exploded view of a base unit in accordance with an embodiment of the present invention.

In one embodiment, as shown in FIGS. 1 and 2, the base unit 12 has two side walls 20, a front portion 22, a back wall 24, a base wall or portion 26, and a top wall or portion 28. In the illustrated embodiment, there are three containers 16 and three associated container receiving regions 14. Furthermore, in the embodiment shown in FIG. 1, the container receiving regions 14 have a width, height, and depth that are slightly larger than the width, height, and depth of the containers 16. This configuration allows a container 16 to be easily received by a container receiving region 14 and maintains an efficient use of space. In the illustrated embodiment of FIG. 1, the top portion 28 rests on top of and is connected to the two side walls 20, the back wall 24, and the front portion 22. In this embodiment, the top portion 28 extends from the back wall 24 to the front portion 22 wherein the containers 16 rest completely under the top portion 28 when the containers 16 are held inside the container receiving regions 14.

The construction and configuration of the container system 10 shown is an example and not intended to be limiting. For example, the number of containers 16 and associated receiving regions 14 may vary. It is also contemplated that the container receiving regions 14 and containers 16 may vary in size and may not necessarily be uniform in size. In other embodiments, the top portion 28 of the base unit 12 may be an integral unit with any combinations of the side walls 20, back wall 24, and front portion 22. It is also contemplated that the containers 16 may only be partially under the top portion 28 when the containers 16 are held inside the container receiving regions 14.

Furthermore, in the embodiment illustrated in FIG. 1, a base handle 30 is mounted to the top portion 28 of the base unit 12. In this embodiment, the base unit 12 has a hollowed-out portion 32 in the top portion 28 in which the base handle 30 is situated. In the illustrated embodiment, the base handle 30 is connected pivotally to the base unit by a pivot pin 34. When the base handle 30 is not in use, the base handle 30 may rest inside the hollowed-out portion 32 with a portion of a side of the base handle 30 disposed against the surface of the hollowed-out portion 32. When the base handle 30 is in use, the base handle 30 may be pivoted to an upright position, thus allowing the base handle 30 to be grasped to lift the entire container system 10. It is contemplated that the base handle 30 may also be mounted to the base unit 12 in a fixed position and that other connection means, such as screws, fastenings, bolts, or adhesive bonding, may be used. In one embodiment, the base handle 30 is mounted to the top portion 28 without a hollowed-out portion 32. There may be a grip material such as, for example, rubber, plastic, or other material on the base handle 30 to provide slip resistance and comfort during transport of the container system 10.

In one embodiment, the base unit 12 includes a lid 36 that forms part of the top portion 28. In one embodiment, the lid 36 is opaque. In the embodiment illustrated in FIG. 1, the lid 36 is connected to the base unit 12 pivotally at a pivot connection 38. The lid 36 may be pivoted from a closed position (as shown in FIG. 1) to an open position (as shown in FIG. 2). The lid 36 may be connected to the base unit 12 using pins, screws, fastenings, bolts, or any other connection mechanism as would be appreciated by one skilled in the art. The lid 36 may also be a slide-on lid which is slid on to the top portion 28 of the base unit or a snap-on lid that is snapped on to the top portion 28 of the base unit 12. It is contemplated that the methods of mounting the lid 36 on to the top portion 28 may vary and the number of lids 36 may vary. In the embodiment shown in FIG. 2, the lid 36 has an extension 40 on the side opposite the pivot connection 38 that facilitates the lid 36 to be lifted to a position that permits access to the contents of the top portion 28. Furthermore, in this embodiment, a depression 42 is formed in the top portion 28 of the base unit 12 underneath the extension 40 to permit easier access to the extension 40. It is contemplated that the size, shape, and location of the extension 40 may vary.

In one embodiment, as shown in FIG. 1, the outer surface 44 of the side walls 20 has at least a portion made of aluminum with diamond treads. It should be appreciated that the outer surface 44 of the side walls 20 may be made of other materials and with other patterns. For example, a portion of the outer surface 44 of the side walls 20 may have grooves. For convenience, an inward finger recess 46 may be formed in a hollowed out portion 50 in at least one or both side walls 20. In one embodiment, the inward finger recess 46 is formed between a ledge 48 and the hollowed out portion 50 in the side wall 20. The inward finger recess 46 may facilitate the lifting of the entire container system 10. It is also contemplated that a handle may be attached to at least one or both side walls 20.

In one embodiment, the base unit 12 includes front rails 52 between the container receiving regions 14. As shown in FIG. 2, the front portion 22 comprises two vertical side portions 53, a top rail 55, a bottom rail 57, and a plurality of front rails 52 extending between the vertical side portions 53. At least one end of a front rail 52 is attached to a shelf 54 that protrudes from the inner surface 56 of the vertical side portions 53. The front rails 52 may be attached to the shelves 54 using screws, pins, fastenings, bolts, adhesive bonding, or other attachment means appreciated by one skilled in the art. In another embodiment, the front rails 52 may be attached to the vertical side portions 53 having no shelves 54. It is contemplated that the front rails 52 may also be attached to the side walls 20.

In one embodiment, each base unit latch 18 is mounted to a front rail 52. The base unit latch 18 may have a tongue portion 58 with a manually engageable surface 59 that is to be depressed to unlatch the container 16 from the base unit 12. The base unit latch may further include an integral spring element or portion 60. It is contemplated that the manually engageable surface 59 may be located on a portion that is different in location, size, and shape than the tongue portion 58 shown in this embodiment. There may also be a depression 64 in the mounting portion 62 of the front rail 52 that permits the tongue portion 58 to move in a downward direction when the tongue portion 58 is depressed. The spring element 60 may be located in the depression 64.

Figure 3:
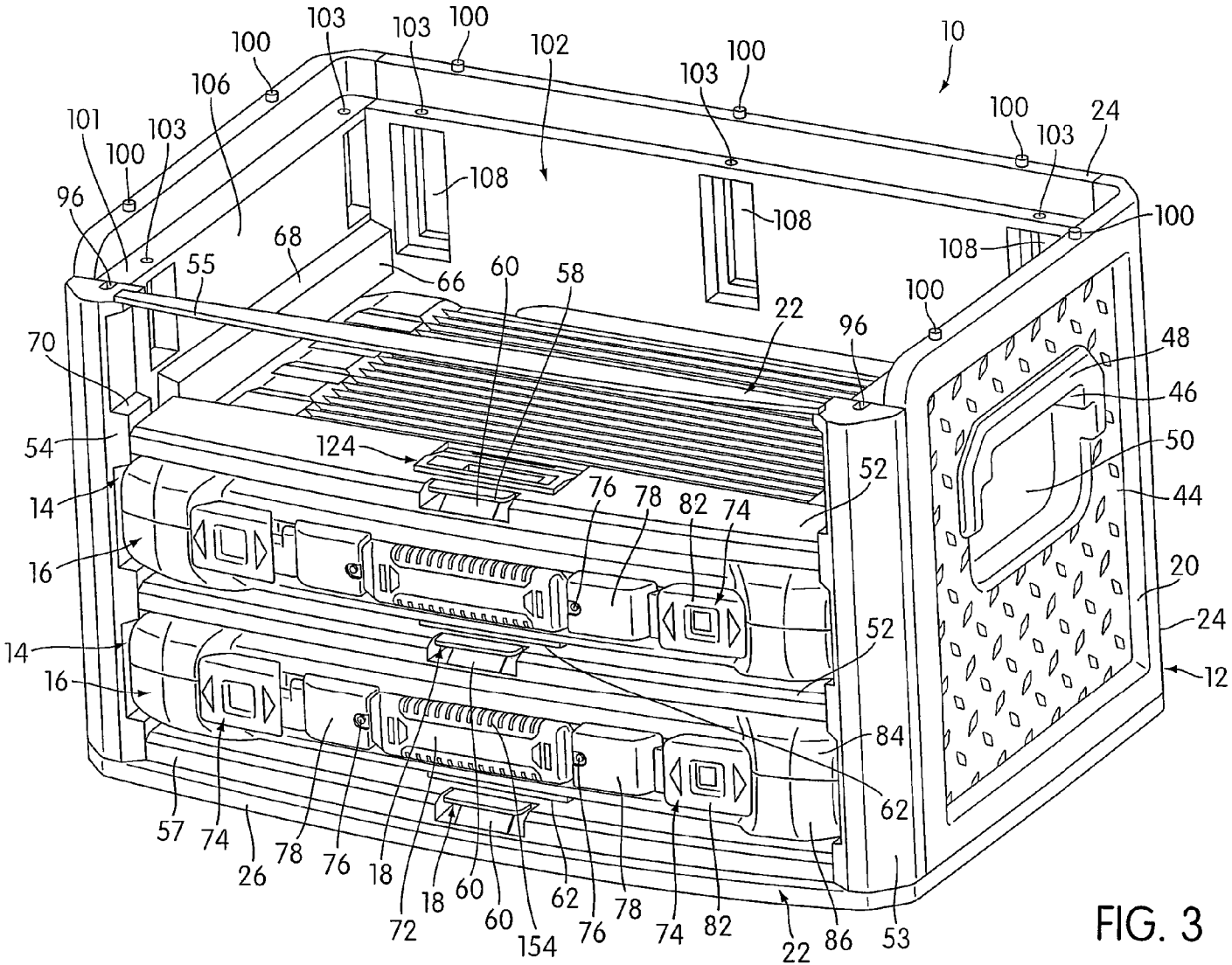
FIG. 3 is a perspective view of the container system with the top portion and lid removed.

In the embodiment shown in FIG. 2, the base unit 12 has slide rails 66 on the inner surface 106 of the side walls 20. The containers 16 slide on these slide rails 66 when the container is taken out of or placed into its associated container receiving region 14. The top surface 68 of the slide rails 66 may be vertically aligned with the top surface 70 of the associated shelves 54 (as shown in FIG. 3) so that a container 16 contacts the top surface 68 of the slide rails 66 and the top surface 70 of the shelves 54 when the container 16 is slid into and out of the associated container receiving region 14. There may also be a space between the shelves 54 and the associated slide rails 66. Alternatively, it is contemplated that a side of a shelf 54 may be disposed against a side of the slide rail 66, thus forming a single rail on which a container 16 may slide. In the embodiment shown in FIG. 3, when a container 16 is latched within a container receiving region 14, the container 16 is supported by the slide rails 66 on both sides of the container 16. In this embodiment, each base unit latch 18 is situated at least partially under the container 16 when a container 16 is latched to the base unit latch 18 and the container 16 is inside its associated container receiving region 14.

Referring back to FIG. 1, each container 16 has a first portion 84 and a second portion 86, wherein the relative movement of the first portion 84 and second portion 86 between an opened and closed position permits and prevents access to the contents of the container 16, respectively. In this embodiment, each of the containers 16 also has two container latches 74 and a container handle 72 to facilitate transport of each container 16 separately from the base unit 12. Each end of the container handle 72 is connected to the container 16 via a pin 76 that is inserted through a handle attachment cover 78 and into a handle slot 80 (shown in FIG. 12). It is contemplated that the container handle 72 may be fixed and nonextendible, or of other various kinds appreciated in the art. The attachment mechanism of the container handle 72 to the container 16 may vary and may be, such as, for example, screws, bolts, fasteners, or any other mechanism as appreciated by one skilled in the art. The slide mechanism 82 of the container latch 74 may be slid away from or towards the container handle 72 to lock and unlock the container 16. The container latches 74 may vary in numbers (it may have one or more) and may be pivotable latches, buckles, or any other latching mechanism as would be appreciated by one skilled in the art.

In the embodiment shown in FIG. 2, the top portion 28 of the base unit 12 has an upper compartment 88 under the lid 36. The upper compartment 88 may be divided into several sections by partitions 90. The partitions 90 may be received in slots 89 located on side surfaces 91 and a bottom surface 93 of the upper compartment 88. It is contemplated that the size and partitioning of the upper compartment 88 may vary. For example, the locations of the partitions 90 may be change by inserting the partitions 90 into different slots 89. In the embodiment shown in FIG. 2, the base handle 30 is mounted to the top portion 28 of the base unit 12 in a cut-out 92 in the pivotal lid 36. The cut-out 92 is not limited to the shape, size, and location shown in FIG. 2. For example, the cut-out 92 may be the same size as or slightly larger than the recess or hollowed-out portion 32 of the top portion 28 where the base handle 30 is situated. In the embodiment shown in FIG. 2, the lid 36 is disposed against a ledge 94 provided by the top portion 28 of the base unit 12 when the lid 36 is closed. It is contemplated that the size of the lid 36 may vary and may extend beyond the edges of the top portion 28.

In the embodiment shown in FIG. 2, the top portion 28, side walls 20, base portion 26, back wall 24, and front portion 22 are connected to form the base unit 12 via snap fit connections. There are projections 100 on the top of the two side walls 20, the back wall 24, and the front portion 22 that snap into the receiving openings (not shown) on the bottom of the top portion 28. Each of the side walls 20 has a ledge 101 with receiving openings 103 formed in the ledge 101. The ledges 101 may be used to support the top portion 28, and there may be projections (not shown) on the top portion 28 that are received in the receiving openings 103 formed in the ledges 101. In the embodiment shown in FIG. 2, the front portion 22 has notches 96 that receive projections (not shown) from the top portion 28. It is contemplated that other connections may be used, such as, for example, screws, pins, fastenings, or bolts. It is further contemplated that any combinations of the top portion 28, side walls 20, base portion 26, back wall 24, and front portion 22 may be an integrally molded unit.

In the embodiment shown in FIG. 2, a base unit space 102 is defined in the base unit 12 by the top portion 28, side walls 20, back wall 24, base, and front portion 22. The container receiving regions 14 may be fully situated in the base unit space 102. In the embodiment illustrated by FIG. 2, the front rails 52 form part of the front portion 22 of the base unit 12 and extend at least partially into the base unit space 102. In this embodiment, each container receiving region 14 is separated from another container receiving region 14 by the associated front rail 52. There is space between the front rail 52 and the back wall 24 wherein the container receiving regions 14 communicate with adjacent container receiving regions 14. It is also contemplated that the front rail 52 may extend to and come into contact with the back wall 24, thus forming a partition fully separating the container receiving regions 14 wherein the container receiving regions 14 do not communicate with adjacent container receiving regions 14.

In the embodiment shown in FIGS. 2 and 3, the slide rails 66 are situated on the inner surface 106 of the side walls 20. In one embodiment, each container receiving region 14 has an elongated slide rail 66 on each side wall 20.

In one embodiment, the base unit 12 has vertical hollowed-out portions 108 formed in the inner surface of the back wall 24. In the embodiment shown in FIGS. 2 and 3, there are at least three vertical hollowed-out portions 108. There may also be horizontal hollowed out portions 109 formed in the inner surface of the back wall 24. There may be at least two horizontal hollowed out portions 109 formed in the back wall 24. The configuration of the vertical hollowed-out portions 108 and horizontal hollowed out portions 109 shown is an example and not intended to be limiting.

In the embodiment shown in FIG. 2, the base portion 26 of the base unit 12 is connected to the rest of the base unit 12 using snap connections. In one embodiment, the bottom surfaces of the two side walls 20 and the back wall 24 have projections (not shown) that snap into the openings 110. There may also be projections (not shown) on the two side walls 20 and the back wall 24 that snap into the circular openings 113 on the base portion 26. Furthermore, in this example, the base portion 26 has depressions 111 formed on the surface of the base portion 26. In one embodiment, there may be at least three depressions 111 that extend along the surface of the base portion 26. In this embodiment, the base unit 12 has feet structures 112. The feet structures 112 may protrude from the bottom of the base portion 26.

FIG. 3 shows an embodiment wherein each container receiving region 14 has a slide rail 66 on each side wall 20. The containers 16 are supported by the slide rails 66 when the containers 16 are inside their associated container receiving regions 14. At least a portion of a container 16 rests on a slide rail 66. Each slide rail 66 extends in one piece at least partially along the inner surface of the side wall 106. It is contemplated that other forms of the slide rail 66 may be used. For example, the container system 10 may have more than two slide rails 66 for each container receiving region 14.

Figure 4:
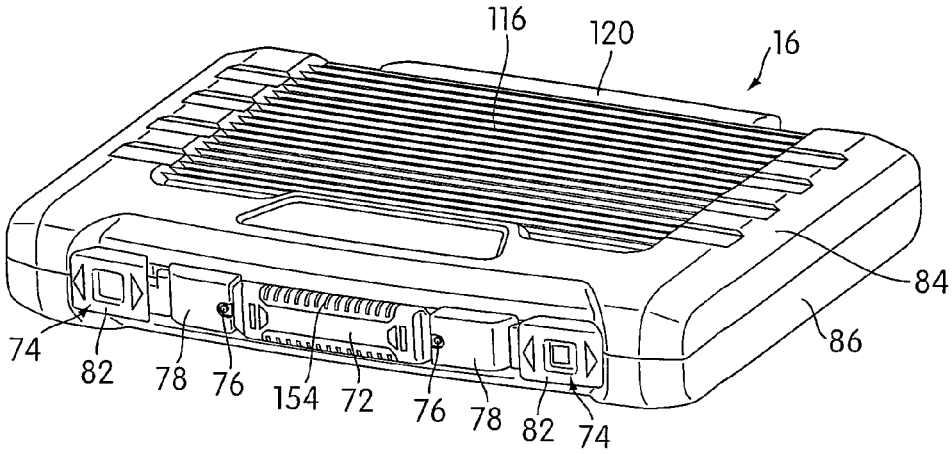
FIG. 4 is a perspective view of the top side of a container.
Figure 5:
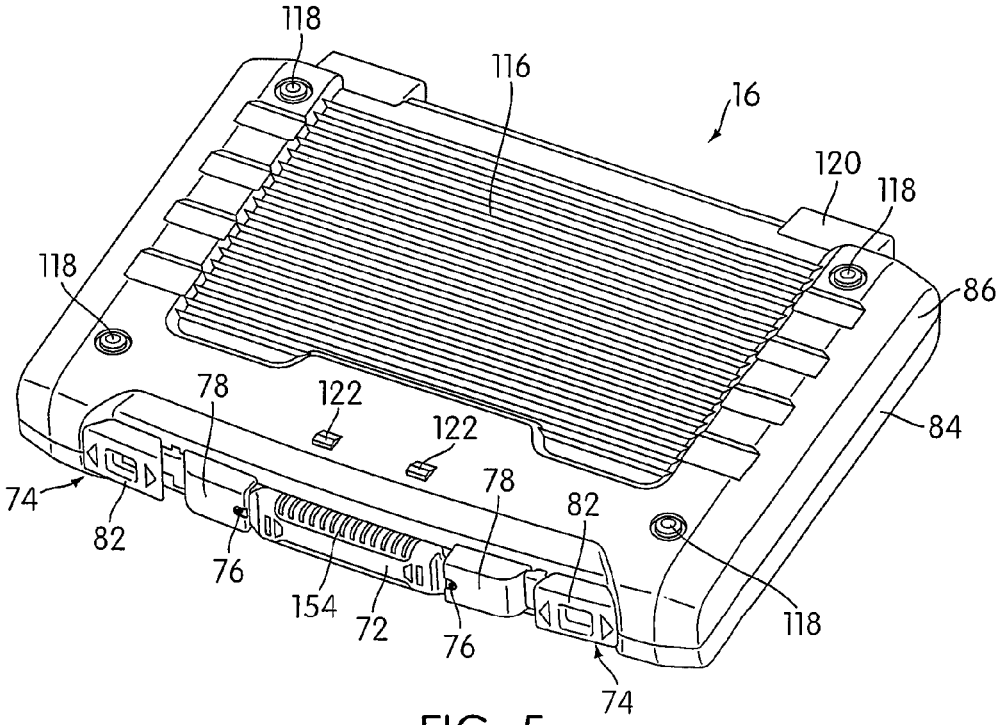
FIG. 5 is a perspective view of the underside of a container.

FIGS. 4-5 show the top and bottom sides of the container 16. Each of the containers 16 has a container handle 72 to facilitate transport of each container 16 separately from the base unit 12. Each container 16 has a first portion 84 and a second portion 86, wherein the relative movement of the first portion 84 and second portion 86 between an opened and closed position permits and prevents access to the contents of the container 16. The containers 16 may hold drive sets or other tools and accessories.

Furthermore, as shown in FIGS. 4 and 5, the container 16 has a plurality of grooves 116 on the outer surface of the first portion 84 of the container and on the outer surface of the second portion 86 of the container 16. In addition, the container 16 has four skid resistant feet 118 on the surface of the second portion 86 to facilitate, in one embodiment, the second portion to function as a bottom portion of the container 16 when opened while resting on a horizontal surface. It is contemplated that there may be additional feet 118 or fewer feet 118 in other embodiments of the container 16. The feet 118 of the container 16 may be made of plastic, rubber, or other materials, and may be round, square, or other various shapes. The feet 118 may rest on a supporting surface when the first portion 84 is moved relative to the second portion 86 to permit access the contents of the container 16. In one embodiment, the container 16 also has an attachment protrusion 120 on the side opposite the container handle 72. The size, number, and location of the attachment protrusion 120 may vary. Moreover, the container 16 may have a lock engagement portion 122 on the surface of the second portion 86 as shown in FIG. 5. In one embodiment, the lock engagement portions 122 are tabs or protrusions formed on the container 16. It is contemplated that the number of engagement portions 122 and the location of the engagement portions 122 may vary. For example, the lock engagement portion 122 may be one tab located on the container 16. It is further contemplated that the lock engagement portion 122 may have other shapes than the one shown in FIGS. 5, 10, and 11. For example, they can be recesses rather than protrusions.

Figure 6:
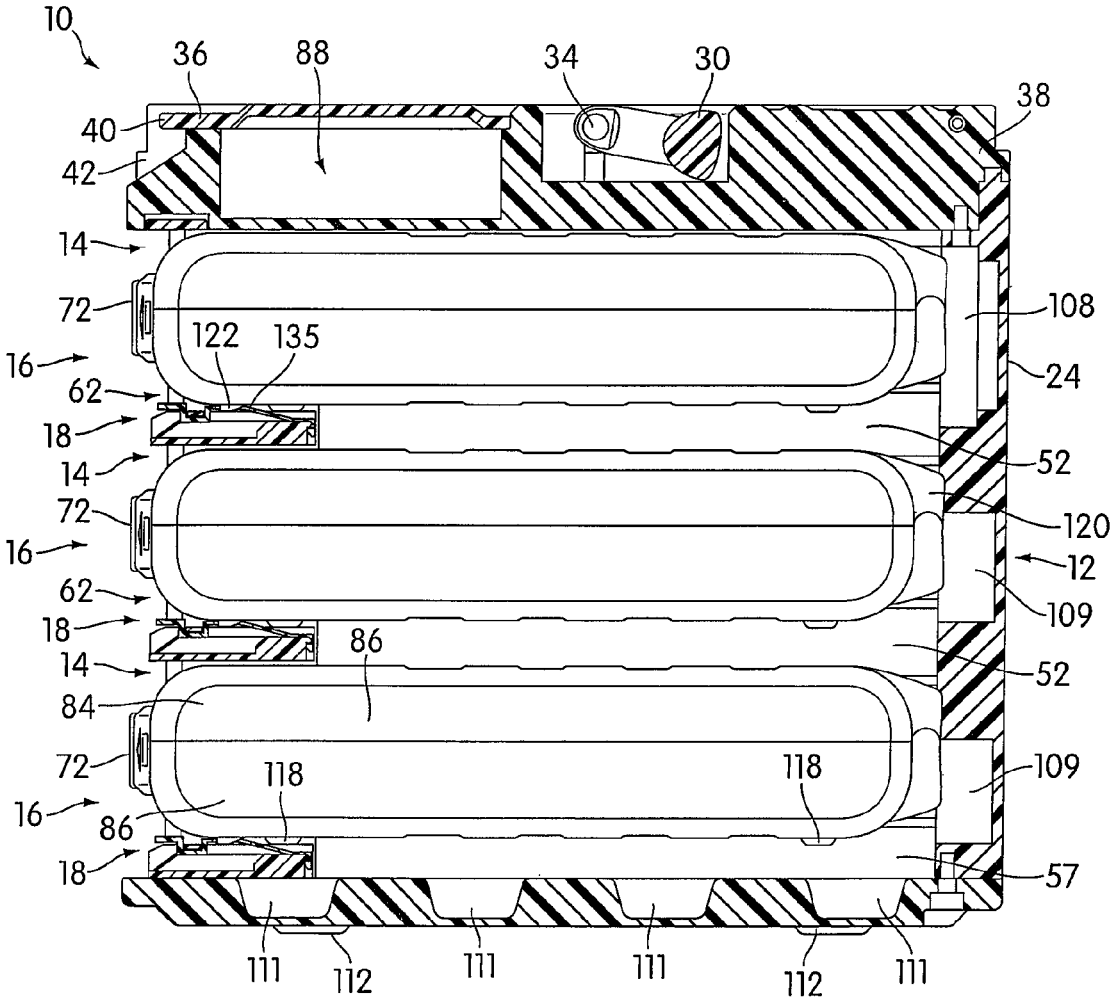
FIG. 6 is a side view of the container system.
Figure 7:
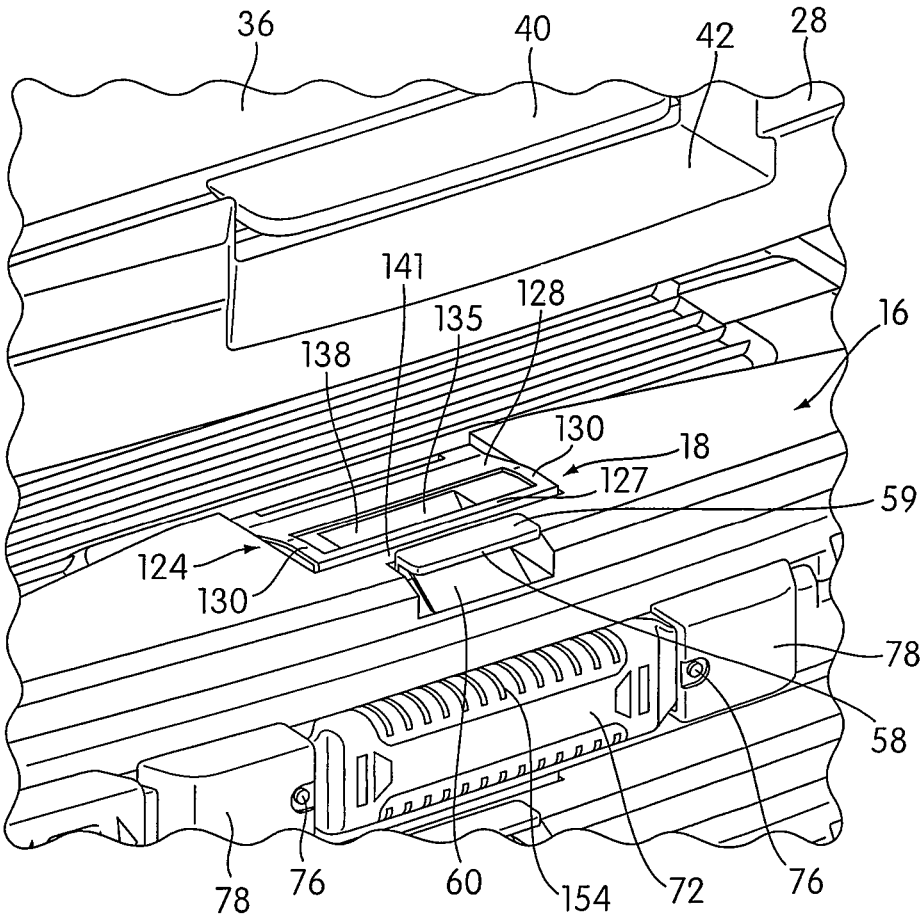
FIG. 7 is a perspective view of a latch mechanism mounted on the base unit.

FIG. 6 is a side view of the containers 16 held inside the container receiving regions 14. When the containers 16 are inside the container receiving regions 14, the containers 16 rest on the slide rails 66. When the containers 16 are inside the container receiving region 14, the containers 16 may be latched to the base unit 12. As illustrated, the container 16 closest in proximity to the top portion 28 is in a position wherein the attachment protrusion 120 of the container 16 is outside the vertical hollowed-out portion 108 of the back wall 24. In FIG. 6, the container 16 situated in the middle of the row of containers is in a position wherein its attachment protrusion 120 is slightly touching the back wall 24, which may serve as a stop surface in one embodiment. It is contemplated that the attachment protrusions 120 may be positioned at various distances from the back wall 24 or disposed against the back wall 24 when the containers 16 are latched to the base unit 12. However, a container 16 may be held inside the container receiving region 14 without the container 16 being latched to the base unit 12. In one embodiment, the container 16 may be in an unlatched position relative to the base unit 12 when the container 16 is pushed into the container receiving region 14 to a position wherein the attachment protrusion 120 on the container 16 is within the horizontal hollowed-out portions 108 or the vertical hollowed-out portions 109 of the back wall 24. In this position, the tab 122 of the container may be outside of the opening 135 of the resilient latch member 124. This position is not intended to be limiting, and the containers 16 may rest in other positions within the container receiving region 14 wherein the containers 16 are not latched to the base unit 12.

Figure 8:
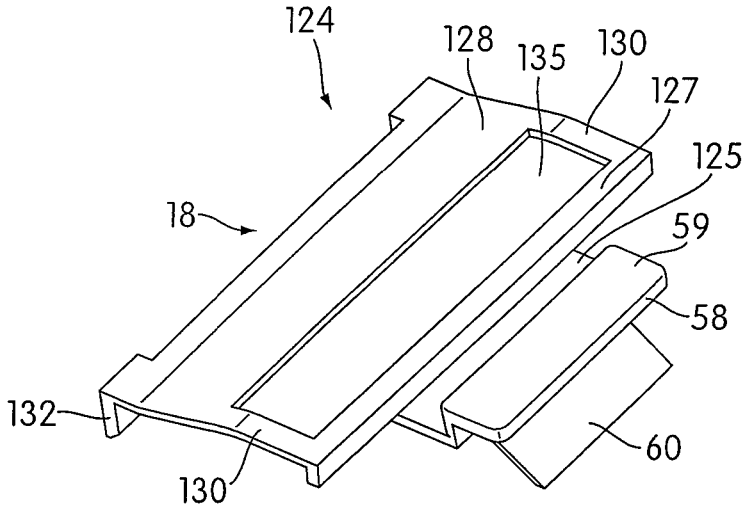
FIG. 8-9 is a perspective view of the latch mechanism for the container system.
Figure 9:
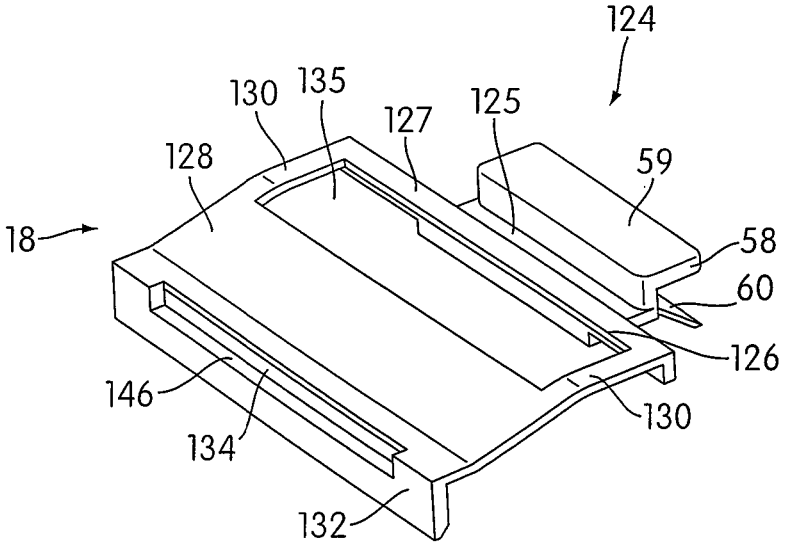

In the embodiment of FIGS. 8 and 9, the base unit latch 18 comprises two basic components, one associated with the base unit 12, in the form of a resilient latch member 124, and another associated with the container 16, such as a projection or tab 122. The resilient latch member 124 is mounted on the front rail 52 of the base unit 12. The resilient latch member 124 is connected at one end to the base unit 12 and has an opposite end that is manually engageable to facilitate flexing of the resilient latch member 124 from a lock position wherein the associated container 16 is locked in the associated container receiving region 14, to a release position wherein the associated container 16 is able to be removed from the associated container receiving region 14. In one embodiment, the resilient latch member 124 is made of nylon plastic material. The use of nylon plastic as the resilient latch member 124 material is not intended to be limiting and other kinds of materials may be used, such as, for example, various metal, plastic, and other resilient materials.

Figure 10:
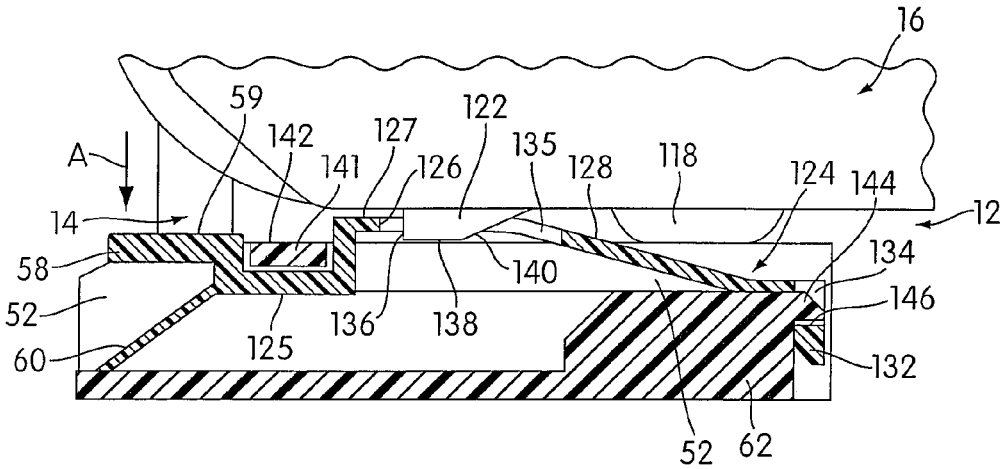
FIG. 10 is a side sectional view of a container engaged with the base unit.
Figure 11:
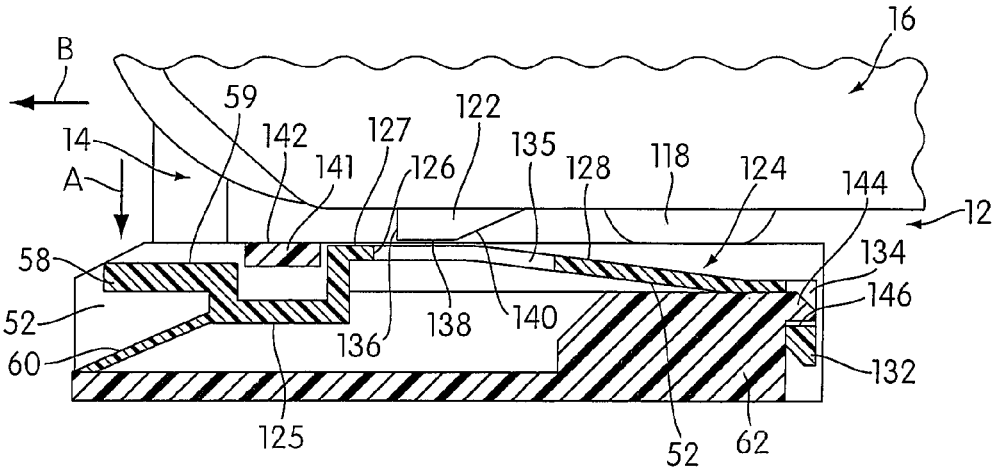
FIG. 11 is a side sectional view of a container disengaged from the base unit.

In one embodiment, the resilient latch member 124 includes the integral spring element 60 that biases the resilient latch member 124 to a lock position, a tab stop surface 126 that interferes with the tab 122 on the container 16 to prevent movement of the tab 122 therebeyond and thereby prevent removal of the associated container 16 from the container receiving region 14, and the manually engageable surface 59, which when moved against the bias of the resilient latch member 124 moves the tab stop surface 126 out of an interfering relation with the tab 122. The resilient latch member 124 may also have an opening 134, such as a connection slot, that receives a connecting portion 144, as described in more detail below, of the base unit 12 to connect the resilient latch member 124 to the base unit 12. In the embodiment shown in FIG. 8, the resilient latch member 124 has one spring element 60; a tab stop portion 127 with a tab stop surface 126 that interferes with the tab 122 on the container 16 to prevent movement of the tab 122 therebeyond; the tongue portion 58 with the manually engageable surface 59 which when moved against the bias moves the tab stop surface 126 out of an interfering relation with the tab 122; a restraint portion 125 that connects the tongue portion 58 to the tab stop portion 127; a slant portion 128; a bridge portion 130 that connects the tongue portion 58 and the spring element 60 to the slant portion 128; an end portion 132; and a connection slot 134 in the end portion 132 of the resilient latch member 124 that receives a portion of the base unit 12. The tongue portion 58 may be depressed to move the resilient latch member 124 against the bias from a lock position to a release position (as shown in FIGS. 10 and 11) wherein the associated container 16 may be removed from the associated container receiving region 14. In the embodiment shown in FIGS. 8 and 9, the resilient latch member 124 has an opening 135 that receives the lock engagement portion 122 of the container 16. In this embodiment, the connection slot 134 receives a portion of the base unit 12 to connect the resilient latch member 124 to the base unit 12. The connection slot 134 will be discussed further below. The aforementioned structure of the resilient latch member 124 is an example and is not intended to be limiting. The resilient latch member 124 may comprise of any combination of the aforementioned portions.

FIGS. 10 and 11 are perspective views of the base unit latch 18 from the container system 10. In FIG. 10, the container 16 is latched onto the front rail 52 of the base unit 12 via the resilient latch member 124. In one embodiment, the resilient latch member 124 is mounted to the front rail 52 midway between the two side walls 20. It is contemplated that the resilient latch member 124 may be mounted to the front rail 52 at various other positions between the two side walls 20. In one embodiment, the lock engagement portion 122 of the container 16 is a tab 122, which comprises of an engaging surface 136, a cam surface 140, and a sliding surface 138. In one embodiment, a reference structure 141 of the front rail 52 is situated between the tongue portion 58 and the tab stop portion 127 of the resilient latch member 124. The reference surface 142 of the reference structure 141 may align with the surface of the front rail 52. In one embodiment, the reference surface 142 is fixed, and the relative movement of the tongue portion 58 to the reference surface 142 causes the spring element 60 to be compressed or relaxed. When the spring element 60 is in a relaxed state, the restraint portion 125 may be disposed against the reference structure 141. In one embodiment, the spring element 60 is in contact with the mounting portion 62 of the base unit 12. In the embodiment shown in FIGS. 10 and 11, when the tongue portion 58 is not depressed, the spring element 60 is in a relaxed position wherein the tab stop surface 126 of the tab stop portion 127 is disposed against the engaging surface 136 of the tab 122 in an interfering relation with the tab 122, thus preventing the container 16 from being able to move in a direction out of the container receiving region 14. Furthermore, in one embodiment, when the container 16 is inserted into the container receiving region 14, the cam surface 140 engages in a camming action against the tab stop portion 127 and depresses the tab stop portion 127 downwards against the bias of the spring element 60 so that the sliding surface 138 of the tab 122 may slide on the tab stop portion 127 until the tab 122 is aligned with the opening 135 of the resilient latch member 124, at which point the spring element 60 snap the tab stop portion 127 upwards so that the tab 122 is captured within opening 135. In this embodiment, when the tab 122 is inserted into the opening 135, the resilient latch member 124 is biased into a lock position wherein the tab stop surface 126 acts to interfere with and engage the engaging surface 136 of the tab 122 to latch the container 16 to the base unit 12. Furthermore, in one embodiment, when the container 16 is pushed further into the container receiving region 14 towards the back wall 24, the cam surface 140 of the tab 122 engages in a camming action against the slant portion 128, forcing the slant portion 128 to align with or rest below the surface of the front rail 52. In other embodiments, the cam surface 140 may engage in a camming action against any portion of the resilient latch member 124.

In the embodiment shown in FIGS. 10 and 11, the resilient latch member 124 is mounted to the front rail 52 via the connecting portion 144 of the base unit 12, in the form of a protrusion, on the mounting portion 62 of the base unit 12 that is inserted into the connection slot 134 of the resilient latch member 124. As shown in the embodiment of FIG. 9, the connection slot 134 of the resilient latch member 124 is formed at a bend in the end portion 132 of the resilient latch member 124. Referring back to FIGS. 10 and 11, when the protrusion 144 of the mounting portion 62 is inserted into the connection slot 134, the protrusion 144 is disposed on a ledge 146 forming a lower surface of the connection slot 134 at the end portion 132 of the resilient latch member 124. The protrusion 144 of the mounting portion 62 maintains the end portion 132 of the resilient latch member 124 in a fixed position. Other methods of mounting the resilient latch member 124 to the base unit 12 may be used, such as, for example, screws, pins, fastenings, bolts, adhesive bonding, or any other attachment mechanism as would be appreciated by one skilled in the art.

FIG. 11 shows the container 16 being unlatched from the base unit 12. In one embodiment, the tongue portion 58 is depressed in the direction of arrow A, which causes the spring element 60 to compress against the mounting portion 62 of the front rail 52. The tab stop portion 127 is lowered so that the tab stop surface 126 is below and is not in an interfering relation with the engaging surface 136. The lowering of the tab stop portion 127 may also lower the slant portion 128 via the bridge portion 130. The end portion 132 may remain in a fixed position. Because the tab stop surface 126 is no longer in an interfering relation with the engaging surface 136, the container 16 may now be pulled out of the container receiving region 14 in the direction of arrow B.

Figure 12:
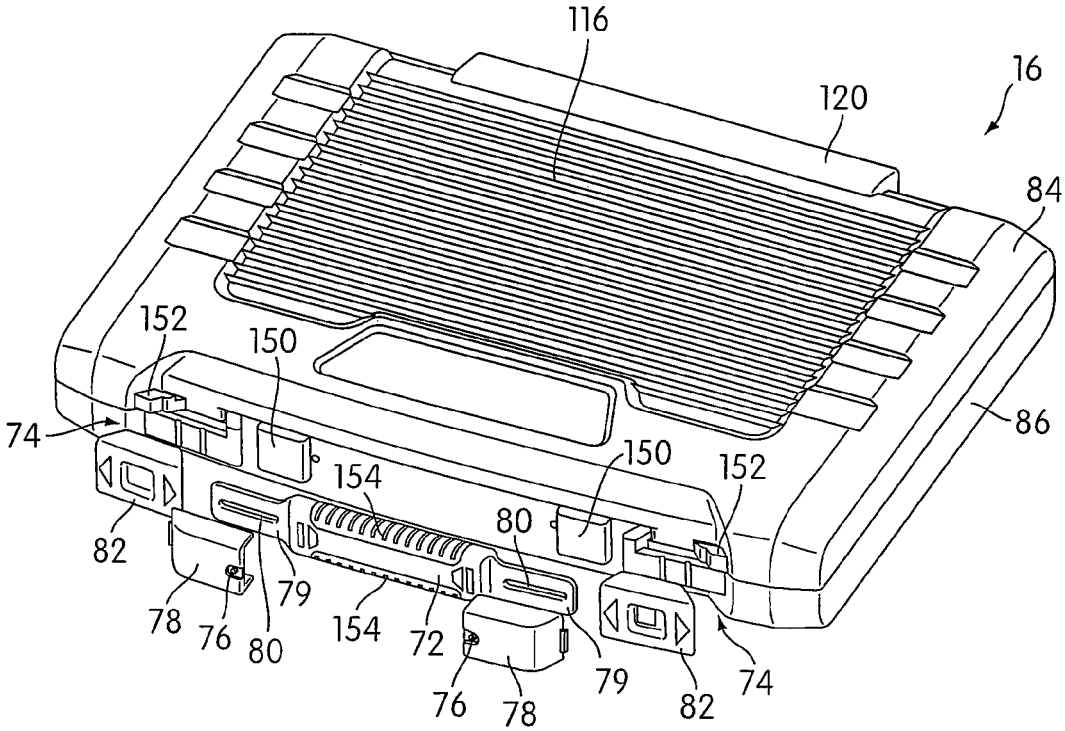
FIG. 12 is an exploded view of a container of the container system.

FIG. 12 shows an exploded view of the exterior of a container 16. The first portion 84 and the second portion 86 of the container 16 may be attached using screws, bolts, fastenings, or any other attachment mechanism as would be appreciated by one skilled in the art. The container 16 has at least one container latch 74 to enable the container 16 to be latched in the closed position. In the embodiment shown in FIG. 12, the container 16 has two slide latches 74 and a flexible handle 72. The container handle 72 may have ridges 154 on both sides to facilitate gripping of the container handle 72. It is contemplated that the container handle 72 may have other textures. In the embodiment shown in FIG. 12, the container handle 72 has flexible end portions 79. Each flexible end portion 79 has a slot 80 formed therein. The two slots 80 on each end portion can be used to attach the container handle 72 to the container 16. The handle connection pin 76 is received in the slot 80. When the container handle 72 is pulled away from the container 16, the end portions 79 are flexed and the pin 76 slides along the slot 80. A handle attachment cover 78 may rest on both sides of the container handle 72 and may cover the slots 80 when the container handle 72 is not extended. In this embodiment, the handle connection pin 76 is inserted through the handle attachment cover 78. Furthermore, in this embodiment, the handle attachment cover 78 snaps on to the handle attachment member 150 located on the container 16 to mount the handle attachment cover 78 to the container 16. It is contemplated that the container handle 72 may attach to the container 16 via other means, such as, for example, screws, bolts, fastenings, or any other attachment mechanism as would be appreciated by one skilled in the art. The slide mechanism 82 of the container latch 74 may be slid in a direction opposite or towards the container handle 72 to lock and unlock the container 16. To lock the container 16, the sliding mechanism 82 of the container latch 74 may be slid in the direction opposite the container handle 72 to engage the lock engagement member 152.

Furthermore, in the illustrated embodiment of FIG. 12, the container 16 has grooves 116 on the outer surface of the first portion 84 and second portion 86. Other embodiments of the surface of the container 16 may be smooth or have other textures. The containers 16 may store tool sets and other accessories. The containers 16 may be placed into the container receiving unit 14 when the container system 10 is to be transported. In the embodiment shown in FIG. 3, when a container 16 is inserted into a container receiving region 14 of the base unit 12, the container 16 passes through the front portion 22 and into the container receiving region 14 towards the back wall 24 of the base unit 12. This container system 10 allows the transport of the container system 10 to a worksite, and the removal of the containers 16 holding certain sized tool sets whenever the tool sets are needed. The containers 16 may also be removed from the base unit 12 and transported separately.

Figure 13:
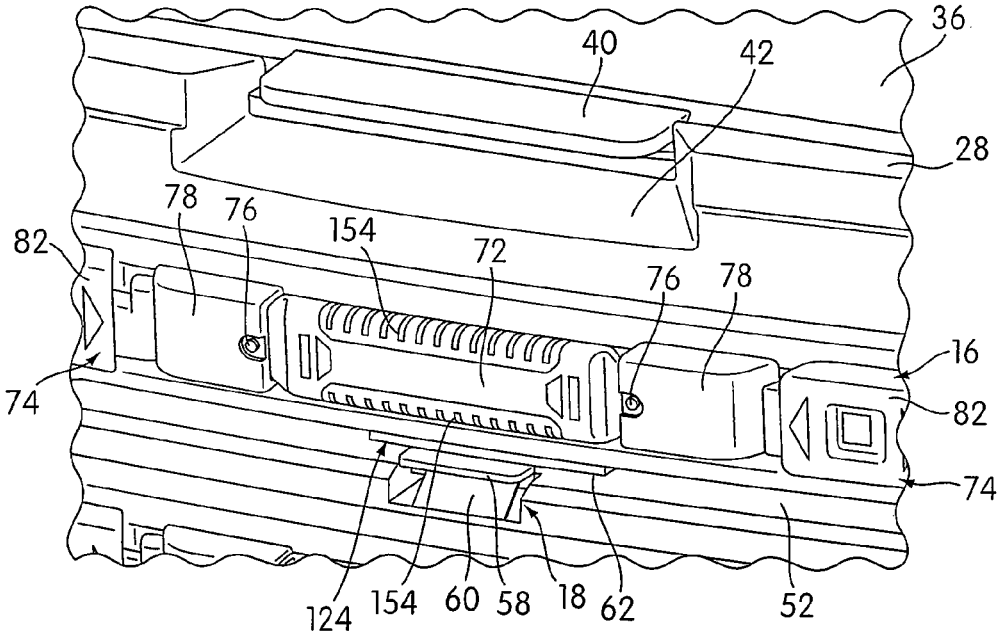
FIGS. 13-14 depict disengaging and removing a container from the base unit.
Figure 14:
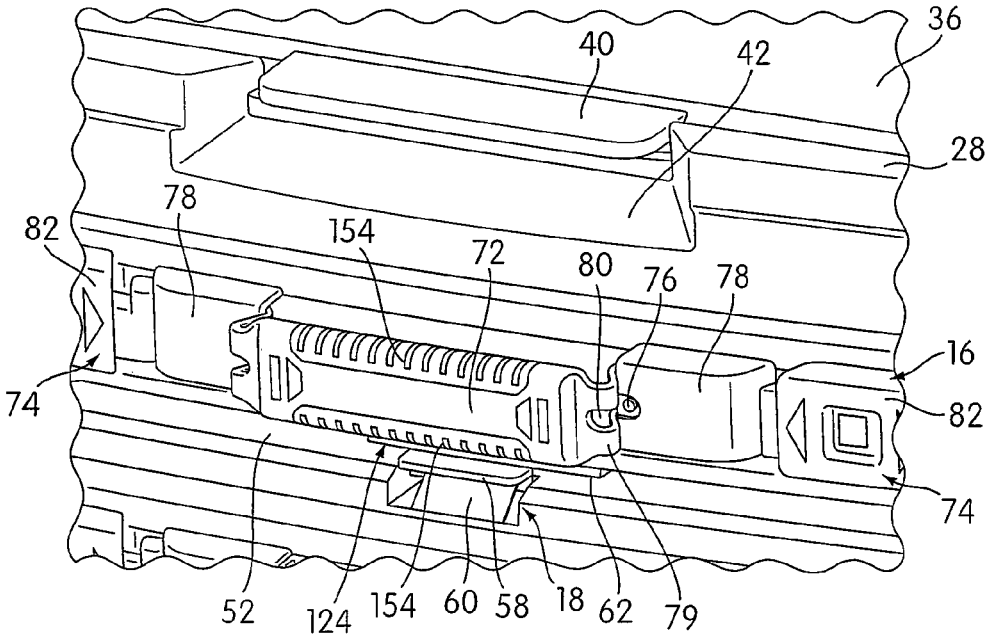

FIGS. 13 and 14 depict removing the container 16 from the base unit 12. The tongue portion 58 of the latch is depressed to unlatch the container 16. In one embodiment, depressing the tongue portion 58 moves the tab stop portion 127 against the bias of the spring element 60, thus lowering the tab stop portion 127 so that it is no longer in an interfering relation with the engaging surface 136. The container 16 is then pulled out of the container receiving region 14 by the container handle 72. FIG. 14 shows an embodiment of the container system 10 with the container handle 72 in its extended form. When the container handle 72 is pulled away from the container 16 so that the container handle 72 is fully extended, the handle pin 76 is in a position in the slot 80 farthest from the container handle 76. When the container 16 is being pulled from the container receiving region 14, the tabs 122 of the containers 16 slide on the surface of the front rail 52 and then on the reference surface 142.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment may be combined with one or more features of any other embodiment.

What is claimed is:

1. A container system comprising:

a base unit, the base unit having a plurality of container receiving regions, a base carrying handle to facilitate lifting and carrying of the base unit;

a plurality of containers, each of said containers being constructed to be received in an associated one of the container receiving regions so as to be vertically stacked in the base unit, each of the containers having a container handle to facilitate transport of each container separately from the base unit, each container having a first portion and a second portion, wherein relative movement of the first and second portions between an opened and closed position permits and prevents access to contents of the container, each container having at least one container latch to enable the container to be latched in the closed position, wherein the base carrying handle is positioned above and in alignment with the vertically stacked containers; and a plurality of base unit latches, each base unit latch arranged to latch an associated one of the containers at least partially within the associated one of the container receiving regions, wherein each base unit latch comprises a manually engageable release member that is configured to be actuated to unlatch the associated one of the containers in the closed position from the associated one of the container receiving regions in the base unit and to remove the associated one of the containers completely from the associated one of the container receiving regions.

2. The container system of claim 1, wherein each container receiving region has slide rails on which the associated container slides.

3. The container system of claim 1, wherein the base unit has a plurality of front rails between the container receiving regions.

4. A container system comprising:

a base unit, the base unit having a plurality of container receiving regions, and a base handle to facilitate transport of the base unit;

a plurality of containers, each of said containers being constructed to be received in an associated one of the container receiving regions, each of the containers having a container handle to facilitate transport of each container separately from the base unit, each container having a first portion and a second portion, wherein relative movement of the first and second portions between an opened and closed position permits and prevents access to contents of the container, each container having at least one container latch to enable the container to be latched in the closed position; and a plurality of base unit latches, each base unit latch arranged to latch an associated one of the containers at least partially within the associated one of the container receiving regions, wherein the base unit has a plurality of front rails between the container receiving regions, and wherein the base unit latches are mounted on the front rails.

5. The container system of claim 1, wherein the base unit has an upper compartment and a pivotal lid.

6. The container system of claim 5, wherein the base unit has a top portion and the base handle is mounted on the top portion of the base unit in a cut-out in the pivotal lid.

7. The container system of claim 5, wherein the pivotal lid is opaque.

8. A container system comprising:

a base unit, the base unit having a plurality of container receiving regions, and a base handle to facilitate transport of the base unit;

a plurality of containers, each of said containers being constructed to be received in an associated one of the container receiving regions, each of the containers having a container handle to facilitate transport of each container separately from the base unit, each container having a first portion and a second portion, wherein relative movement of the first and second portions between an opened and closed position permits and prevents access to contents of the container, each container having at least one container latch to enable the container to be latched in the closed position; and a plurality of base unit latches, each base unit latch arranged to latch an associated one of the containers at least partially within the associated one of the container receiving regions, wherein each base unit latch comprises a resilient latch member connected to the base unit, the resilient latch member being biased into a lock position wherein it engages a lock engagement portion on the associated one of the containers to prevent the container from being removed from the associated container receiving region.

9. The container system of claim 8, wherein the resilient latch member is movable against the bias thereof to a release position wherein the associated container is able to be removed from the associated container receiving region.

10. The container system of claim 8, wherein the resilient latch member comprises at least one spring element that biases the resilient latch member into a lock position.

11. The container system of claim 8, wherein the lock engagement portion is a tab formed on the container.

12. The container system of claim 8, wherein the resilient latch member is made of a nylon plastic material.

13. The container system of claim 11, wherein the resilient latch comprises a tab stop surface that interferes with the tab on the container to prevent movement of the tab therebeyond and thereby prevent removal of the associated container from the container receiving region.

14. The container system of claim 11, wherein the base unit latch includes a manually engageable surface, which when moved against the bias moves the stop surface out of an interfering relation with the tab.

15. The container system of claim 8, wherein the resilient latch member has an opening that receives the lock engagement portion.

16. The container system of claim 8, wherein the resilient latch member is a single piece of material connected at one end to the base unit and has an opposite end that is manually engageable to facilitate flexing of the resilient latch member from the lock position to a release position wherein the associated container is able to be removed from the associated container receiving region.

17. The container system of claim 8, wherein the resilient latch member has an opening that receives a portion of the base unit to connect the resilient latch member to the base unit.

18. A container system comprising: a base unit, the base unit having a plurality of container receiving regions; a plurality of containers, each of said containers being constructed to be received in an associated one of the container receiving regions, each of the containers having a lock engagement portion; and a plurality of base unit latches, each base unit latch arranged to latch one of the containers at least partially within the associated one of the container receiving regions, each base unit latch comprising a resilient latch member connected to the base unit, the resilient latch member being biased into a lock position wherein it engages the lock engagement portion of the associated one of the containers to prevent the container from being removed from the container receiving region, the resilient latch member being movable against the bias thereof to a release position wherein the associated container is able to be removed from the container receiving region.

19. The container system of claim 18, wherein the lock engagement portion is a tab formed on the container.

20. The container system of claim 18, wherein the resilient latch member comprises at least one spring element that biases the resilient latch member into a lock position.

21. The container system of claim 18, wherein the resilient latch member is made of a nylon plastic material.

22. The container system of claim 19, wherein the resilient latch comprises a tab stop surface that interferes with the tab on the container to prevent movement of the tab therebeyond and thereby prevent removal of the associated container from the container receiving region.

23. The container system of claim 19, wherein the base unit latch includes a manually engageable surface, which when moved against the bias moves the stop surface out of an interfering relation with the tab.

24. The container system of claim 18, wherein the resilient latch member has an opening that receives the lock engagement portion on the associated container.

25. The container system of claim 18, wherein the resilient latch member is a single piece of material connected at one end to the base unit and has an opposite end that is manually engageable to facilitate flexing of the resilient latch member from the lock position to the release position.

26. The container system of claim 18, wherein the resilient latch member has an opening that receives a portion of the base unit to connect the resilient latch member to the base unit.

27. The container system of claim 18, wherein the base unit has a plurality of front rails between the container receiving regions.

28. The container system of claim 27, wherein the base unit latches are mounted on the front rails.

29. The container system of claim 1, wherein the base carrying handle is disposed above the base unit.

30. The container system of claim 29, wherein the base carrying handle is attached to a top surface of the base unit.

* * * * *